US006559443B2

(12) United States Patent
Shiokawa et al.

(10) Patent No.: US 6,559,443 B2
(45) Date of Patent: May 6, 2003

(54) IONIZATION APPARATUS AND IONIZATION METHOD FOR MASS SPECTROMETRY

(75) Inventors: Yoshiro Shiokawa, Hachioji (JP); Megumi Nakamura, Fuchu (JP); Yoshiki Hirano, Fuchu (JP); Toshihiro Fujii, Hamura (JP)

(73) Assignee: Anelva Corporation, Tokyo (JP)

( * ) Notice: Subject to any disclaimer, the term of this patent is extended or adjusted under 35 U.S.C. 154(b) by 0 days.

(21) Appl. No.: 09/985,600

(22) Filed: Nov. 5, 2001

(65) Prior Publication Data

US 2002/0053636 A1 May 9, 2002

(30) Foreign Application Priority Data

Nov. 9, 2000 (JP) ..... 2000-342346

(51) Int. Cl.[7] ..... H01J 49/00

(52) U.S. Cl. ..... 250/288; 250/286; 250/282; 250/292; 250/281

(58) Field of Search ..... 250/281–300, 250/423 R

(56) References Cited

U.S. PATENT DOCUMENTS 5,811,800 A * 9/1998 Franzen et al. ..... 250/288

6,075,244 A * 6/2000 Baba et al. ..... 250/292

FOREIGN PATENT DOCUMENTS

JP A 62044947 2/1987

OTHER PUBLICATIONS

Fujii, T., "A Novel Method for Detection of Radiacal Species in the Gas Phase . . . ", Chem. Physics Letters, 191,pp. 162–168, (Mar. 27, 1992).*

* cited by examiner

*Primary Examiner*—John R. Lee
*Assistant Examiner*—Zia R. Hashmi
(74) *Attorney, Agent, or Firm*—Oliff & Berridge, PLC

(57) ABSTRACT

An ionization apparatus and ionization method, wherein an ion trap type structural unit is used as the ion source and an ion emitter for emitting metal ions is provided inside or outside the ion source, metal ions are attached to ingredients of a sample gas to ionize the sample gas, a separation parameter is changed to separate ions relating to a target substance for analysis and the metal ions, the metal ions are trapped and accumulated inside the ion source, and the ions relating to a target substance are ejected to a mass spectrometry unit. Due to this configuration, in ion mass spectrometry, it is possible to accurately separate the ions desired to be analyzed and the ions desired to be trapped by a simple configuration and relatively low resolution and possible to improve the sensitivity of analysis.

9 Claims, 8 Drawing Sheets

IONIZATION APPARATUS AND IONIZATION METHOD FOR MASS SPECTROMETRY

BACKGROUND OF THE INVENTION

1. Field of the Invention

The present invention relates to an ionization apparatus and ionization method for mass spectrometry, and more particularly relates to an apparatus and method for ionization using an ion trap type ion source and metal ion attachment method in ion mass spectrometry.

2. Description of the Related Art

A mass spectrometry apparatus generally introduces a sample gas including a target substance for analysis, ionizes the sample gas, separates and takes out the ions relating to the target substance for analysis from the ions not analyzed, and measures and analyzes the mass. The mass spectrometry apparatus includes an ion source for ionization of the sample gas and a mass spectrometry unit for measuring and analyzing the ions desired to be analyzed. An ion trap type mass spectrometry apparatus can trap ions of a specific mass by a structural unit serving both as the ion source and mass spectrometry unit, so alternately ionizes the gas and analyzes the mass.

There are various methods for ionization of a sample gas in an ion source of a mass spectrometry apparatus. In the electron impact method (EI), electrons are fired at an ionization region into which only the sample gas is introduced so as to directly ionize the sample gas. Further, in the chemical ionization method (CI), electrons are fired into an ionization region where a reaction gas including a small amount of the sample gas is introduced and the reaction gas ionized. Next, the ionized reaction gas (reaction ions) is reacted with the sample gas and the $H^+$ in the reaction ions attached to the sample gas to ionize the sample gas.

In the chemical ionization method, the above ion trap type mass spectrometry apparatus traps the reaction ions, so the opportunities for impact between the reaction ions and sample gas increase. Therefore, compared with an ordinary two-dimensional Q-pole (quadrapole) type mass spectrometry apparatus which does not trap ions, there is the advantage that use is possible at a low pressure.

An ion trap type mass spectrometry apparatus has a structural unit serving as both an ion source and mass spectrometry unit, but a mass spectrometry apparatus of a type with these as independent separate structural units configured so as to use the above characterizing structural unit positively as an ion source has also been proposed (Japanese Patent No. 2679026). In this patent, electron impact ionization or chemical ionization is used as the ionization method in the ion source. The conventional ion source described in that patent is configured to switch between electron impact ionization and chemical ionization as the ionization method. It does this just by changing the parameter of the alternating current or direct current applied to the structural unit, so does not use a mechanical switching operation. Further, in the ionization, ions of all of the ingredients of the sample gas are produced, so only the ions desired to be measured and analyzed are roughly separated and ejected to the mass spectrometry unit. By changing the parameter to control the stable state and unstable state of the ions, the ions desired to be analyzed are ejected to the Z-direction (axial direction of electrode unit) and the ions not analyzed are scattered in the R-direction (radial direction of electrode unit) so as to roughly separate the ions.

Further, one of the methods of ionization is the metal ion attachment method. The metal ion attachment method uses the property that for example the $Na^+$ or other metal ions emitted from the ion emitter gently attach to and ionize the gas molecules in their original form. According to the metal ion attachment method, the production of low molecular weight substances by the disassociation of the sample gas is suppressed and efficient ionization becomes possible.

In an apparatus making positive use of the ion trap structural unit as an ion source such as the mass spectrometry apparatus disclosed in the above Japanese Patent No. 2679026, when using the chemical ionization method, the chemical ionization method (1) produces not the $H^+$ finally added as the reaction ions to react with the sample gas, but $CH_5^+$ or $C_2H_6$ including the same and (2) adds hydrogen to the molecules contained in the sample gas in the reaction, so shifts the ingredients included in the sample gas in mass by exactly 1 amu (atomic mass unit). Therefore, the following problems arise with respect to the separation of the ions desired to be analyzed and the ions not analyzed.

The problem at the time of chemical ionization in a mass spectrometry apparatus using an ion trap structural unit as an ion source is that a high resolution is required for separating [1] the ions to be scattered and extinguished inside the structural unit, [2] the ions to be trapped (reaction ions), and [3] the ions to be ejected to the mass spectrometry unit (ions of target substance for analysis). Further, some ions are not accurately separated even with a high resolution. This will be explained with reference to FIG. 7 and FIG. 8. In FIG. 7 and FIG. 8, the abscissas indicate the mass number, while the ordinates indicate the intensity. These figures show the distribution of the ingredients of the sample gas or the reaction ions or other gases or ions on the abscissas of the mass number.

FIG. 7 is a view for explaining the state of separation of the ions of the above [2] and [3], that is, the ions to be scattered and extinguished inside the structural unit since they are unnecessary for analysis and interfere with the mass spectrometry and the reaction ions to be trapped inside the structural unit for efficient reaction with the target substance for analysis (gas ingredients of sample gas). In FIG. 7, when the reaction gas is methane $CH_4$ (mass 16) 101 as shown in the top graph (A), if an electron beam is fired, as shown by the bottom graph (B) of FIG. 7, a plurality of ions ($CH^+$, $CH_2^+$, $CH_3^+$, $CH_4^+$, $CH_5^+$, $C_2H_3^+$, $C_2H_4^+$, $C_2H_5^+$, $C_3H_3^+$, $C_3H_4^+$, $C_3H_5^+$ and $C_3H_7^+$) are produced. Among these ions, the $CH_5^+$ (102) or $C_2H_5^+$ (103) shown by the hatching in the figure are reaction ions reacting with the sample gas. The other ions shown by the regions 104, 105, and 106 are unnecessary and rather interfere with the mass spectrometry, so should be scattered and extinguished inside. In the case of the above example, the reaction ions have to be trapped in the ion source, while the other ions have to be scattered and extinguished inside the container of the ion source.

As clear from (B) of FIG. 7, since the ions to be scattered and extinguished inside adjoin the reaction ions to be trapped ($CH_5^+$ or $C_2H_5^+$) at the low mass side, it is difficult to separate the two. This requires a hardware configuration having a high resolution, that is, a high precision structural unit and a high degree of voltage control with respect to the structural unit. Further, if set to trap specific ions for separation, the ions on the low mass side from the trapped ions are scattered and extinguished and the ions on the high mass side are ejected to the mass spectrometry unit (the movement of the low mass side and high mass side can also be reversed). Therefore, ions (ions of region 106) are also present at the high mass side of the reaction ions 102 and 103 trapped, but it is impossible to extinguish these.

FIG. 8 is a view for explaining the state of separation of ions of the above [2] or [3] emitted to a mass spectrometry unit for analysis at the mass spectrometry unit. In FIG. 8, the top graph (A) shows two types of reaction ions $CH_5^+$ (201) and $C_2H_5^+$ (202), the middle graph (B) shows the analyzed gas before ionization, and the bottom graph (C) shows the analyzed gas and reaction ions ionized by chemical ionization. The analyzed gas includes as ingredients at least C, $CH_4$, $H_2O$, HF, $C_2$, $C_2H_4$, and $C_2H_6$. If this analyzed gas is ionized by chemical ionization, as shown by the bottom graph (C), the hydrogen ions in the reaction ions are added for a shift of exactly 1 amu to generate ions of $CH^+$, $CH_5^+$, $H_3O^-$, $H_2F^+$, $C_2H_+$, $C_2H_6^+$, and $C_2H_7^+$. Further, in the bottom graph (C), the reaction ions $CH_5^+$ (201*a*) and $C_2H_5^+$ (202*a*) shown by the hatching are the trapped ions. The other ions, that is, the ions included in the regions 203, 204, and 205, are ions ejected to the mass spectrometry unit.

As clear from the array of ions in the bottom graph (C) of FIG. 8, the ranges of the ions to be trapped and the ions to be ejected to the mass spectrometry unit are substantially the same, so a hardware configuration having a high resolution becomes necessary to separate the two. Further, since the ions on the low mass side from the trapped ions are scattered and extinguished, 203 cannot be analyzed in the case of $CH_6$ and 203 and 204 cannot be analyzed in the case of $C_2H_6$. Further, cases arise of complete superposition. In this case, separation becomes impossible.

SUMMARY OF THE INVENTION

An object of the present invention is to solve the above problem and provide an ionization apparatus and ionization method which enable accurate separation of the ions desired to be analyzed and the ions desired to be trapped in mass spectrometry by a simple configuration and relatively low resolution and improve the sensitivity of analysis.

To achieve the above object, the ionization method and ionization apparatus for mass spectrometry according to the present invention are comprised as follows:

The first ionization apparatus is applied to a mass spectrometry apparatus using an ion trap type structural unit as an ion source and is provided with an ion emitter for emitting metal ions inside or outside of the ion source. The metal ions emitted from the ion emitter are attached to the ingredients of the sample gas so as to ionize the sample gas, the preset separation parameter is changed to separate the ions relating to the target substance for analysis and the metal ions, the metal ions are trapped and accumulated inside the ion source, and the ions relating to the target substance for analysis are ejected to the mass spectrometry unit.

According to the above ionization apparatus, by configuring the ion source by combining an ion trap type unit and metal ion attachment method, it is possible to increase the difference of atomic mass units between the ions desired to be analyzed and the ions desired to be trapped at the time of ionization and thereby possible to simply and accurately separate the ions (metal ions) desired to be analyzed by a hardware configuration having a relatively low resolution.

A second ionization apparatus comprises the above configuration wherein further the ion trap type structural unit is comprised of a ring-shaped electrode and two end gap electrodes.

A third ionization apparatus comprises the above configuration wherein further the ring-shaped electrode has a cylindrical shape and the two end gap electrodes have disk shapes. Since it is possible to easily separate the ions of the target substance for analysis, it is possible to make the shape and structure of the electrode portion simpler.

A fourth ionization apparatus comprises the third configuration wherein further an insulator is provided between the ring-shaped electrode and two end gap electrodes; the sample gas is directly introduced inside the ion source; the ion emitter is provided outside the ion source; and an ionization chamber in which the ion source is placed is evacuated so that a pressure outside the ion source becomes lower than a pressure inside it. According to this configuration, since the pressure outside the ion source becomes lower than the pressure inside, it is possible to prevent contact of the sample gas with the ion emitter as much as possible. Due to this, it is possible to prevent the ion emitter from contamination by the sample gas and possible to extend the service life. Note that in the above configuration, the metal ions emitted from the ion emitter are introduced inside the ion source by an electric field generated by the attached electrodes.

A first ionization method is a method for mass spectrometry using an ion trap type structural unit as an ion source comprising generating metal ions, attaching the metal ions to the ingredients of the sample gas to ionize the sample gas, changing the separation parameter to separate the ions relating to the target substance for analysis and metal ions, trapping and accumulating the metal ions inside the ion source, and ejecting the ions relating to the target substance for analysis to a mass spectrometry unit.

According to the present invention, since the sample gas is ionized by the metal ion attachment method in a mass spectrometry apparatus using an ion trap type structural unit as an ion source and provided with a metal ion emitter, it is possible to accurately separate ions desired to be analyzed and trapped ions by a simple configuration and relatively low resolution. Further, since a large amount of the trapped ions, that is, metal ions, is accumulated, it is possible to improve the sensitivity of the mass spectrometry. Further, since the sample gas does not contact the ion emitter, it is possible to prevent contamination of the ion emitter and extend the service life.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Preferred embodiments of the present invention will be explained next with reference to the drawings.

Figure 1:
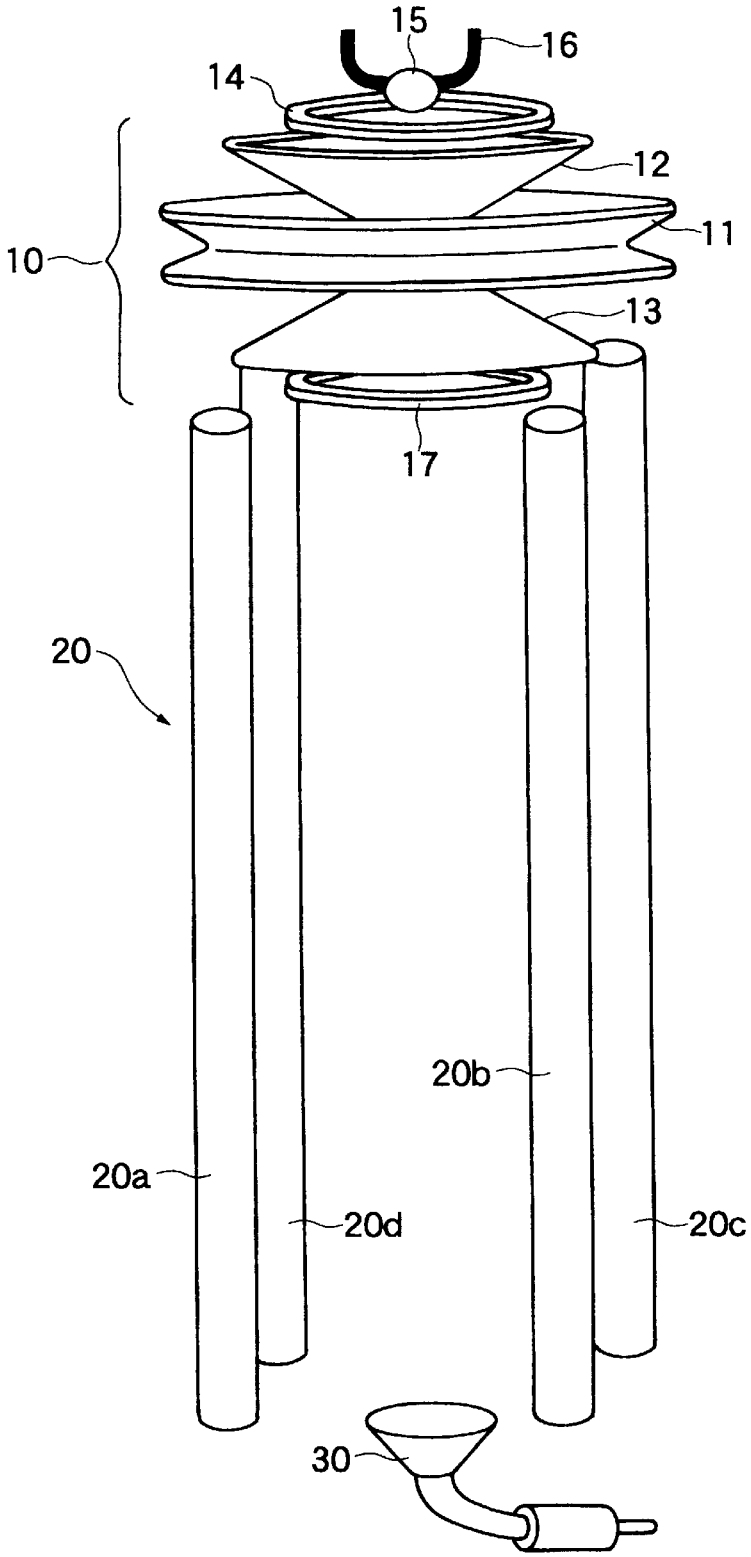
FIG. 1 is a perspective view of a typical embodiment of a mass spectrometry apparatus provided with an ionization apparatus according to the present invention.

FIG. 1 is a view schematically showing a mass spectrometry apparatus provided with an ionization apparatus according to the present invention. This mass spectrometry apparatus is one using a Q-pole type mass spectrometry unit. The portion of 10 is an ion source, the portion of 20 is a mass spectrometry unit, and 30 is a detector. The ion source 10 uses an ion trap type characteristic structural unit. The ion source 10 is comprised of a ring-shaped electrode 11 arranged positioned at the center and having an axial direction in the vertical direction in the drawing and end gap electrodes 12 and 13 arranged above and below the ring-shaped electrode 11. The ring-shaped electrode 11 is formed so that the diameter of the center part in the axial direction becomes smaller. Therefore, the ring-shaped electrode 11 flares outward from the center toward the upper and lower ends. The end gap electrode 12 provided at the top is formed into a trumpet shape formed at the center with a hole (ion intake hole) 12*a* and flaring out toward the top (outside). The end gap electrode 13 provided at the bottom is similarly formed into a trumpet shape formed at the center with a hole (ion ejection hole) 13*a* and flaring out toward the bottom (outside). Note that more precisely the ion source is formed into a three-dimensional hyperbolic shape and forms a three-dimensional quadrapole field inside.

At the top of the upper end gap electrode 12 near the opening is arranged an ion collecting electrode (lens) 14. Further, an ion emitter 15 is arranged above that. The ion emitter 15 is attached to a lead wire 16. The ion emitter 15 is formed of an oxide such as alumina silicate doped with sodium or another metal salt. If sending a required current through the lead wire 16, a heating action occurs and sodium ions are generated and emitted to the surrounding space. Illustration of the power source for supplying current to the lead wire 16 and the power source for supplying voltage to the ion collecting electrode etc. is omitted. The inlet of the sample gas may be above the ion emitter 15 or may be the gap between the ring-shaped electrode 11 and end gap electrode 12 or 13. The ion emitter 15 is arranged at a location in the path through which the sample gas is introduced. Normally, the inlet of the sample gas is provided above the ion emitter 15. In the case of this configuration, the metal ions emitted from the ion emitter 15 are introduced inside the ion source 10 along with the flow of the introduced sample gas. Note that the position of installation of the ion emitter 15 is not limited to the outside of the ion source 10 and can also be provided inside it. Further, as the means for introducing metal ions emitted inside the ion source, it is possible to create a desired electric field by positioning electrodes and introducing the metal ions inside the ion source by the action of this electric field.

Near the lower opening of the lower end gap electrode 13 is arranged another ion collecting electrode 17. The position of arrangement of the ion collecting electrode 17 is the position of the inlet of the mass spectrometry unit. In the mass spectrometry unit 20, 20*a*, 20*b*, 20*c*, and 20*d* are rod-shaped electrodes. A detector 30 is arranged at the position of the outlet of the mass spectrometry unit 20. The detector 30 is configured using an electron multiplier.

In the above mass spectrometry apparatus, an ion trap type ion source is used as the ion source 10, metal ions are generated using the ion emitter 15, and ionization performed by the metal ion attachment method. In FIG. 1, while not accurately shown, the ion source 10 and the mass spectrometry unit 20 are arranged at locations of separate vacuum chambers. The ionization chamber where the ion source 10 is provided and the mass spectrometry chamber where the mass spectrometry unit 20 is provided are evacuated to a required vacuum level by respective evacuation use vacuum pumps (not shown).

The sample gas containing the target substance for analysis is introduced inside the ion source 10 where the metal ions emitted from the ion emitter 15 are attached for ionization. Next, the ions desired to be analyzed from among the plurality of ions after ionization are separated from the metal ions desired to be trapped. The ions desired to be analyzed which are separated move in the axial direction of the ring-shaped electrode 11 and are emitted from the lower end gap electrode 13 to the mass spectrometry unit 20. The ions ejected to the mass spectrometry unit 20 move through the space between the four rod-shaped electrodes 20*a* to 20*d*. Only ions of a specific mass pass through and are taken into the detector 30.

Figure 2:
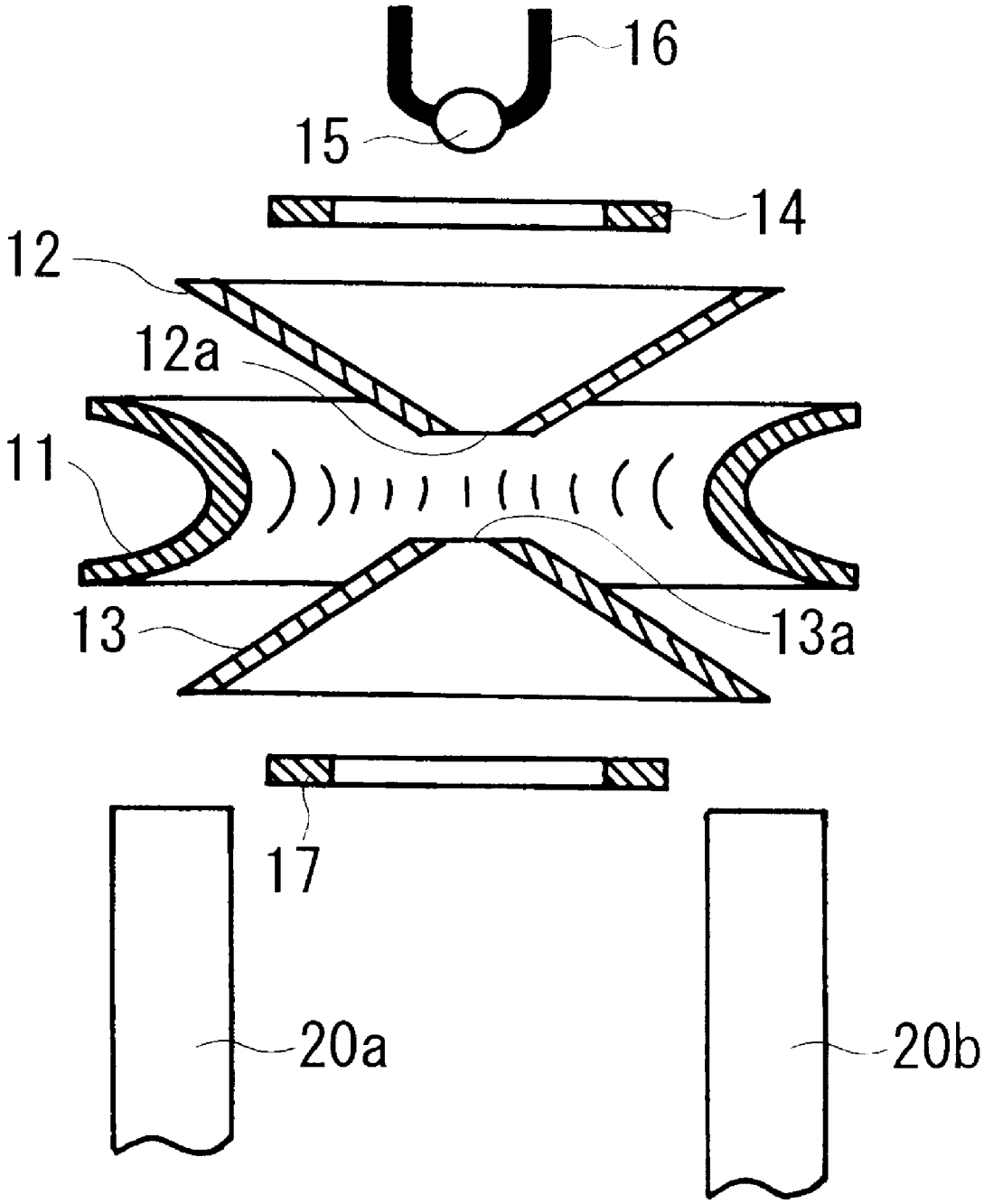
FIG. 2 is a longitudinal sectional view of an ion apparatus according to an embodiment of the present invention.

FIG. 2 is a cross-sectional view showing the ion source 10 enlarged. As clear from FIG. 2, the peripheral edges of the ring-shaped electrode 11 project out so that the center becomes smaller in diameter. The upper and lower end gap electrodes 12 and 13, viewed in sectional shape, are formed enlarged in diameter toward the outside.

In a mass spectrometry apparatus having an ion source 10 using an ion trap type structural unit like the above, the metal ion attachment method is used when ionizing the sample gas. As a result of use of the metal ion attachment method, the following action occurs.

Figure 3:
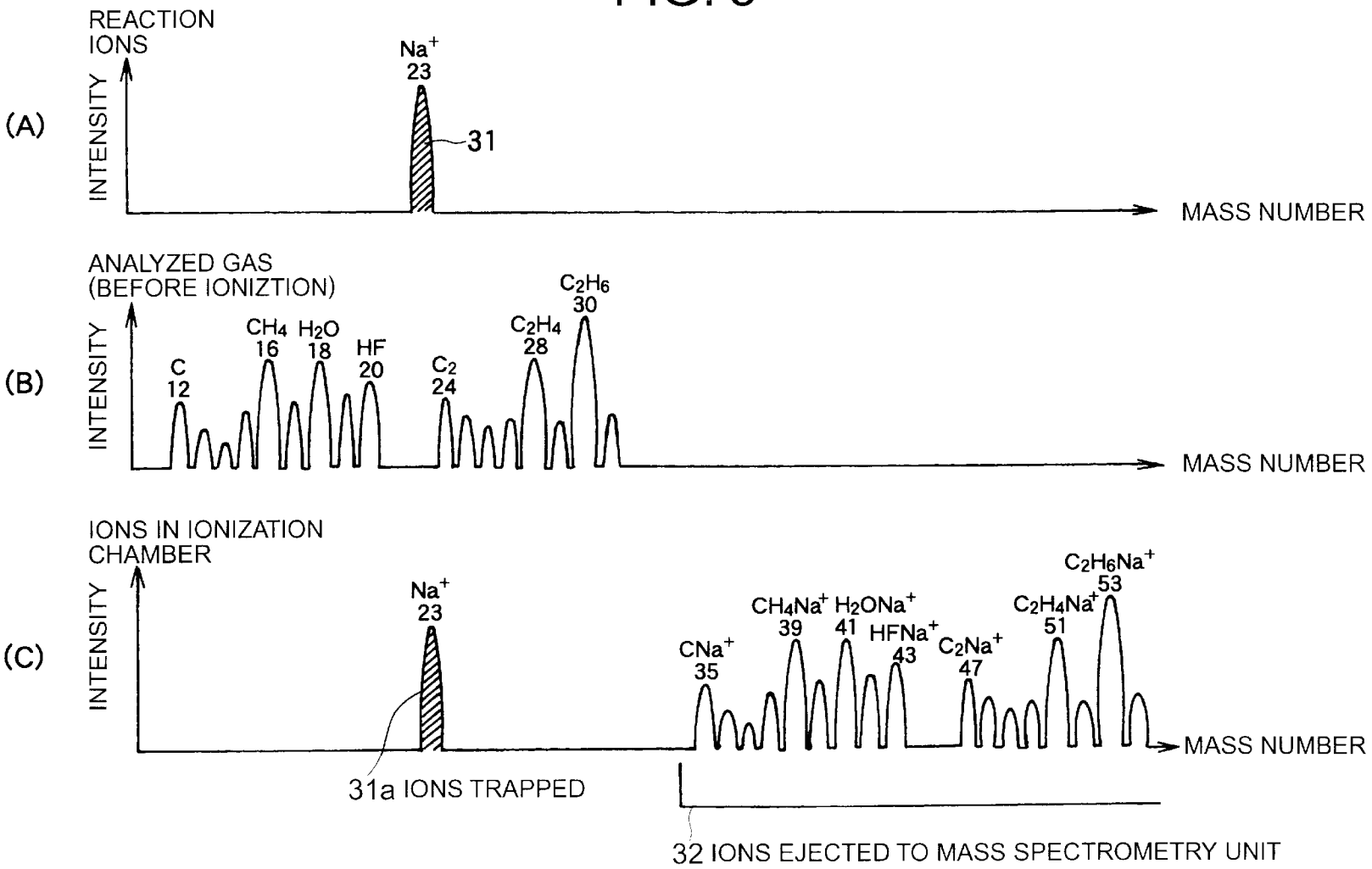
FIG. 3 provides graphs of the state of distribution of the mass number at the time of ionization by an ionization apparatus according to the present invention.

FIG. 3 is a view of the state of distribution of gases or ions when ionizing a sample gas by the metal ion attachment method using sodium ions $Na^+$. In FIG. 3, the top graph (A) shows the position of the sodium ions used in the metal ion attachment method, the center graph (B) shows the state of distribution of the ingredients contained in the detected gas (sample gas) before ionization, and the bottom graph (C) shows the state of distribution of all reaction ions inside the ion source 10. As clear from FIG. 3, if ionizing a gas by the metal ion attachment method using the sodium ions Na+ (31), all of the ions shown by the bottom graph (C) are shifted by exactly the amount of the metal ions from the mass number of the original ingredients shown in the middle graph (B). Therefore, it is possible draw a clear line and separate the plurality of types of ions (ions included in region 32) ejected to the mass spectrometry unit 20 from the sodium ions 31*a* trapped. For example, a difference of 12 amu occurs between the sodium ions $Na^+$ of the mass number 23 and the ions $CNa^-$ of the mass number 35. This is the smallest difference. Therefore, the ions desired to be analyzed can all be ejected to the mass spectrometry unit without any loss.

As clear from the above embodiment, if ionizing the gas using the metal ion attachment method by the ion trap type ion source 10, there is no longer a need for a high resolution in the ion source and the ions trapped by a hardware configuration of a relatively low resolution and ions to be sent to the mass spectrometry unit can be separated. This enables the electrode portion and rest of the structure provided at the ion source 10 to be simplified. Further, in a conventional ion trap type mass spectrometry apparatus, if the amount of the ions to be trapped is increased too much, the drop in the resolution due to the generation of the spatial charge becomes a big problem, but if used as an ion source not requiring a high resolution such as in this embodiment, it is possible to increase the amount of metal ions trapped and enhance the ionization efficiency.

In addition, according to the ion source according to this embodiment, the ions to be trapped and the ions to be sent to the mass spectrometry unit can be simply separated by adjusting the preset separation parameter (control voltage to structural unit) and all ions of the analyzed gas can be separated. That is, it is possible to take all ions attached to the target substance for analysis outside of the ion source and eject them to the mass spectrometry unit while trapping (accumulating) only the metal ions.

Figure 4:
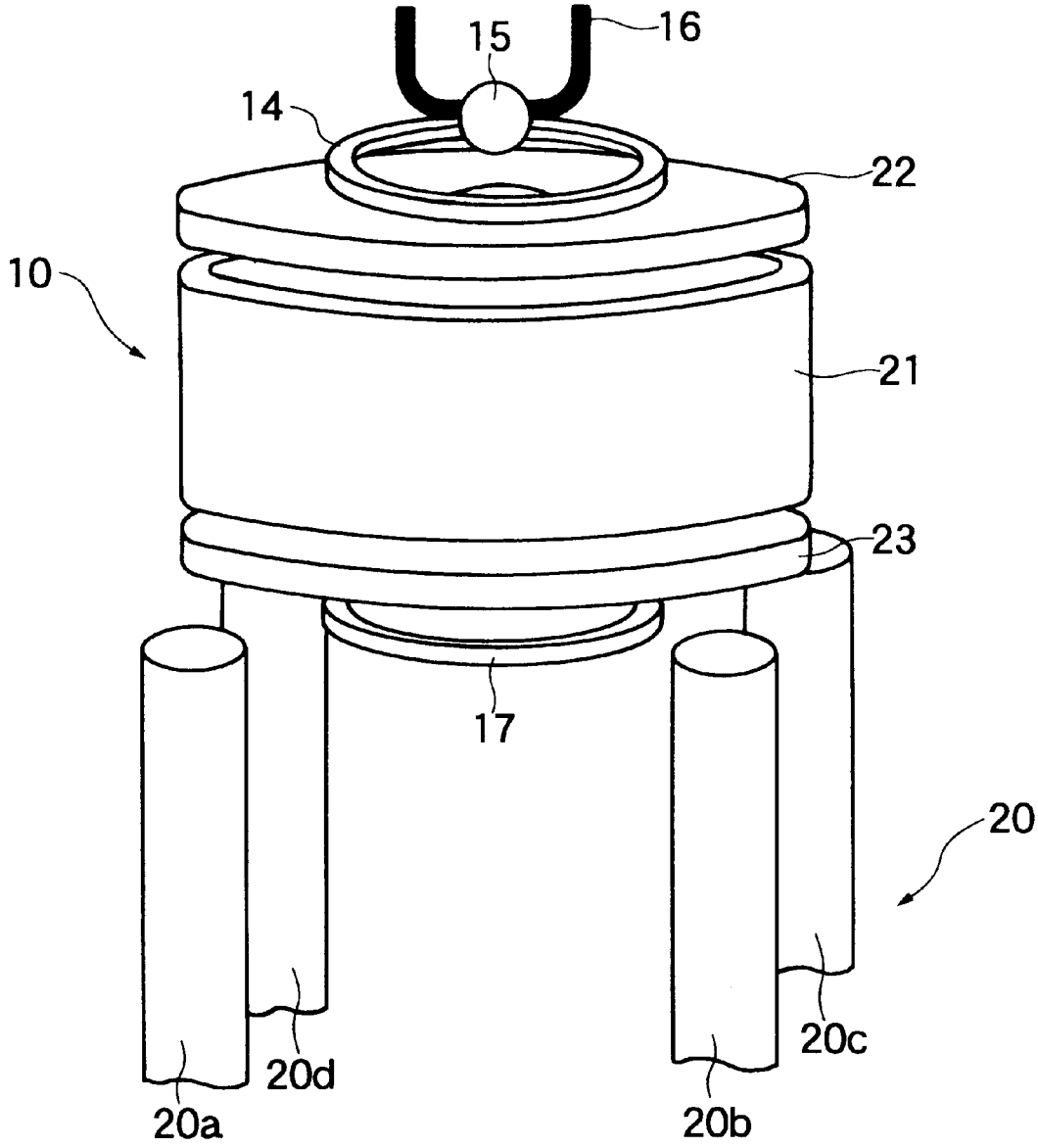
FIG. 4 is a perspective view of principal portions showing another embodiment of an ion apparatus according to the present invention.
Figure 5:
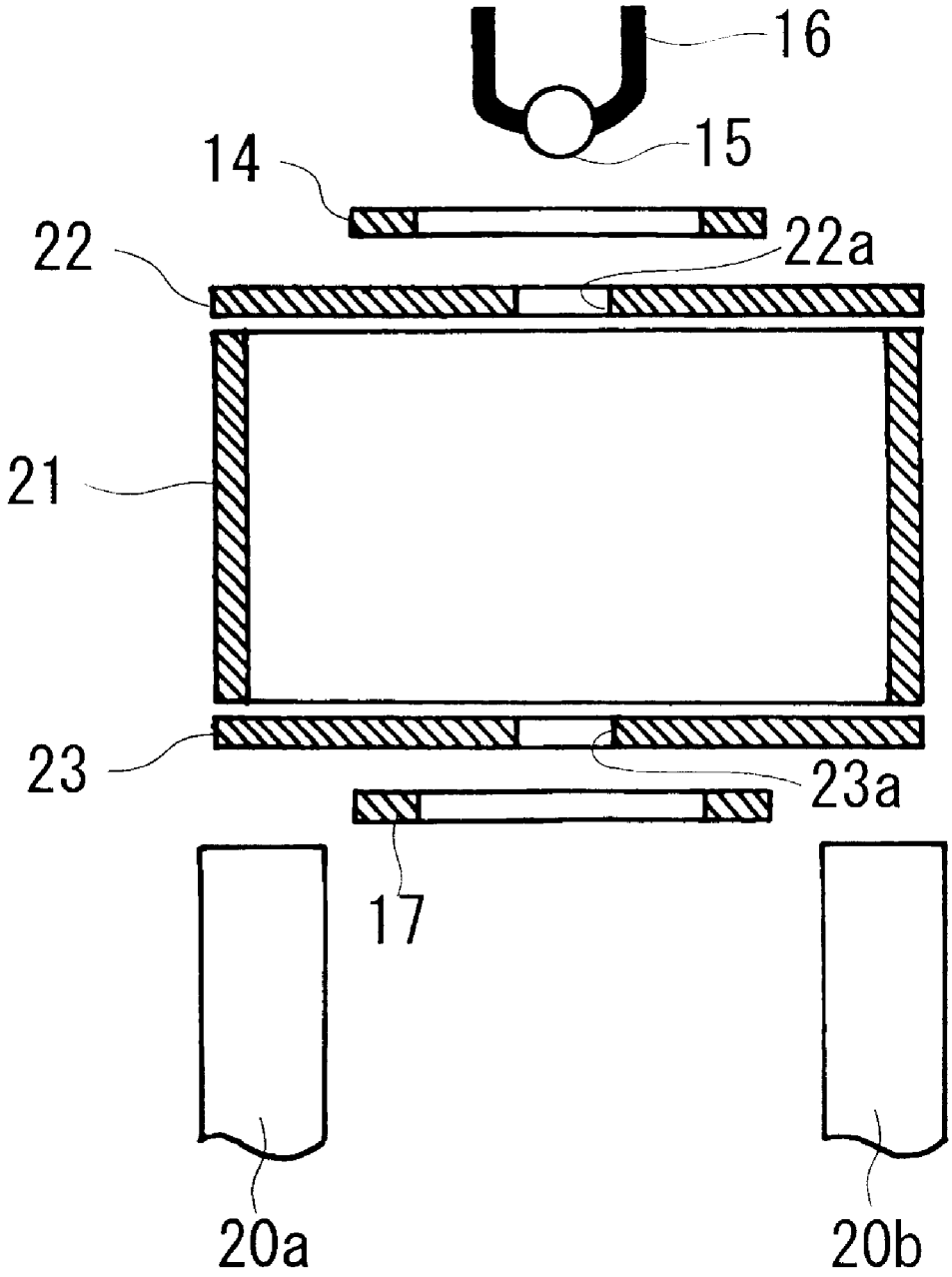
FIG. 5 is a longitudinal sectional view of an ion apparatus according to another embodiment of the present invention.

FIG. 4 and FIG. 5 show another embodiment of an ionization apparatus according to the present invention. This ionization apparatus is used for the ion source of a mass spectrometry apparatus using a Q-pole type mass spectrometry unit in the same way as the above embodiment. FIG. 4 is a perspective view showing the portion of the ion source of the mass spectrometry apparatus enlarged, while FIG. 5 is a longitudinal sectional view of the ion source. The characterizing portion of this embodiment is formed so that the ring-shaped electrode 21 has a cylindrical shape. The two end gap electrodes 22 and 23 at the two sides are formed into disk shapes having holes 22*a* and 23*a* at the center. The shape is not hyperbolic, but an electric field similar to a substantially three-dimensional quadrapole electric field is formed at the inside. The rest of the configuration is the same as the configuration explained in the above embodiment, so elements substantially the same as elements shown in FIG. 4 and FIG. 5 are given the same reference numerals.

With the ion source according to the above embodiment as well, the metal ion attachment method is used for ionization, so similar effects to those of the above embodiment are exhibited. A large difference in mass can be created between the ions desired to be trapped and the ions to be sent to the mass spectrometry unit and the ions can be separated by a low resolution. In particular, in the case of this embodiment, it is possible to simplify the shape of the electrode portion forming the ion source.

Further, in the embodiment shown in FIG. 4 and FIG. 5, when the sample gas is a gas which has corrosiveness and would contaminate the ion emitter, preferably the gap between the ring-shaped electrode 21 and the end gap electrode 22 (or 23) is filled with Teflon (trademark of Dupont) or another insulator to reduce the gas conductance between the inside and outside of the ion source, then a sample gas introduction pipe is arranged to pass through the insulator etc. Further, the ionization chamber where the ion source 10 is provided is evacuated by a vacuum pump. Due to this, the pressure outside the ion source becomes lower than the pressure inside it. Therefore, it is possible to prevent the sample gas from contacting the ion emitter provided at the outside of the ion source and possible to extend the service life. Note that the high concentration sample gas is introduced at the downstream side of the ion emitter 15, so the metal ions emitted from the ion emitter 15 are introduced inside the ion source using the electric field.

Figure 6:
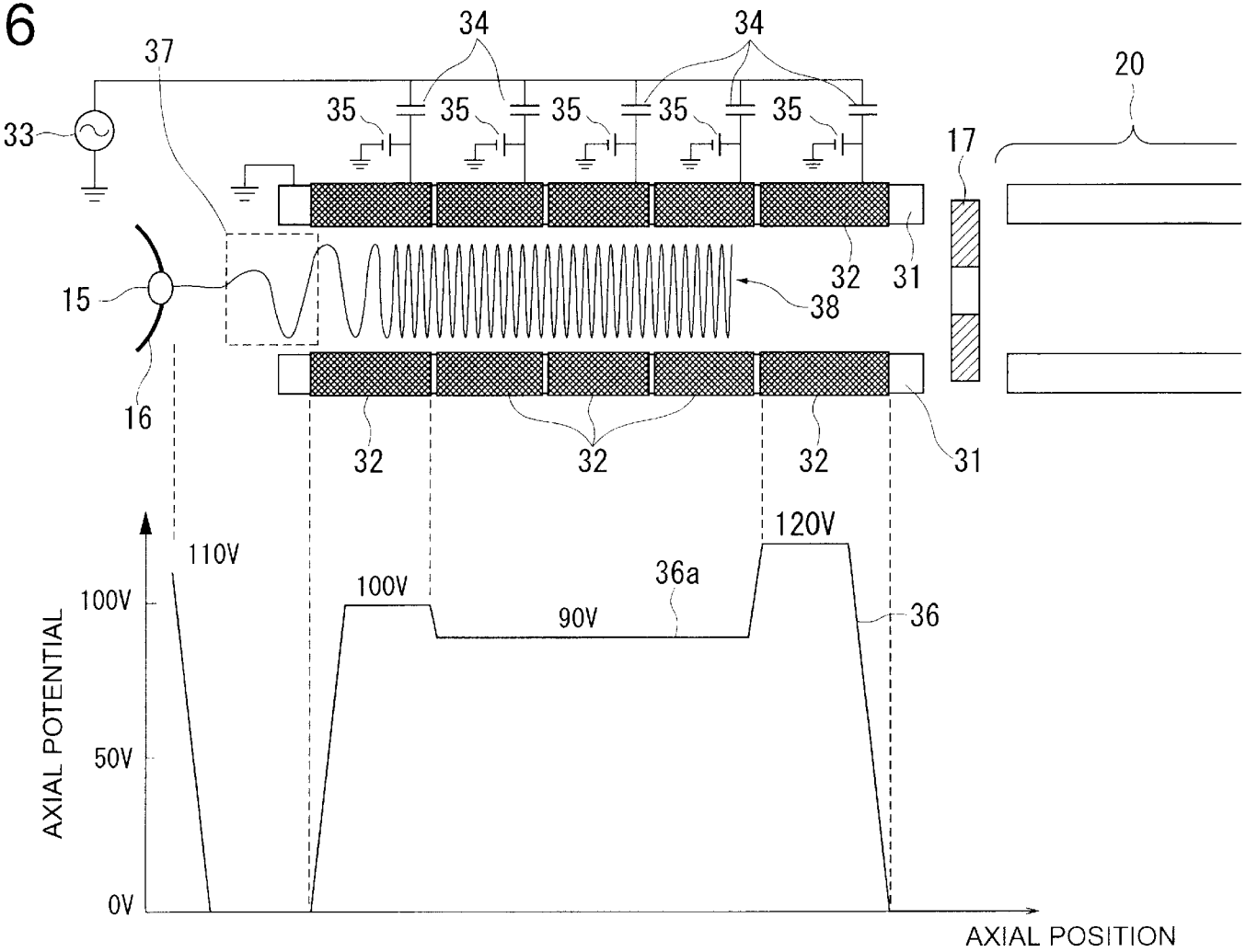
FIG. 6 is a view of the configuration of another embodiment of the present invention.
Figure 7:
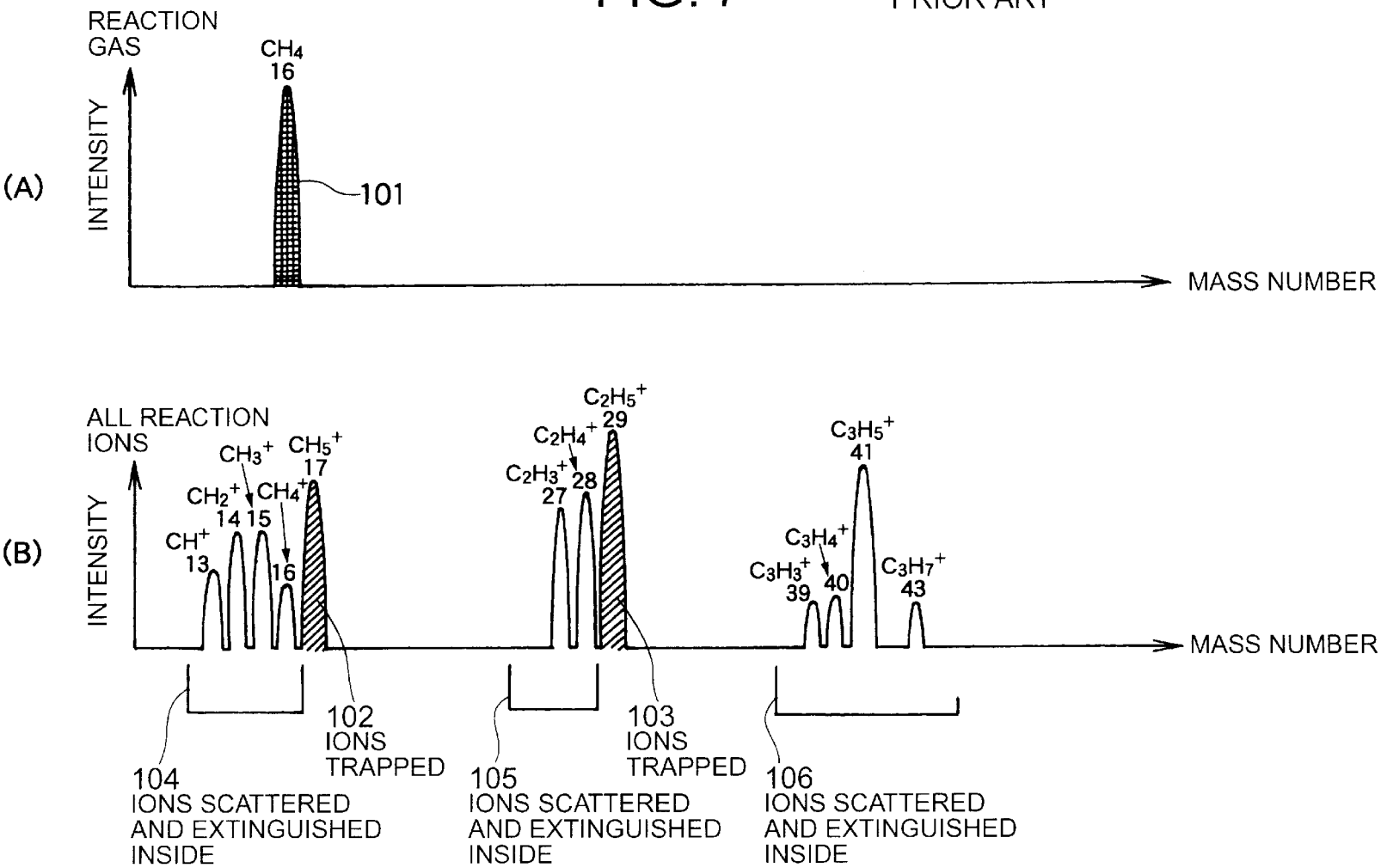
FIG. 7 PRIOR ART
FIG. 7 provides graphs of an example of the state of distribution of the mass number at the time of ionization by an ionization apparatus based on chemical ionization.

Further, in the above embodiment, as the ion trap type structural unit, a three-dimensional quadrapole electric field or electric field similar to it is formed inside, but the invention is not necessarily limited to this. As another embodiment, for example, as shown in FIG. 6, it is possible to trap all ions by a two-dimensional quadrapole electric field in the radial direction, to trap metal ions by the electrostatic field changing in a gate-wise fashion using the difference of ion mobility in the axial direction, and to eject ions desired to be analyzed to the mass spectrometry unit 20.

Figure 8:
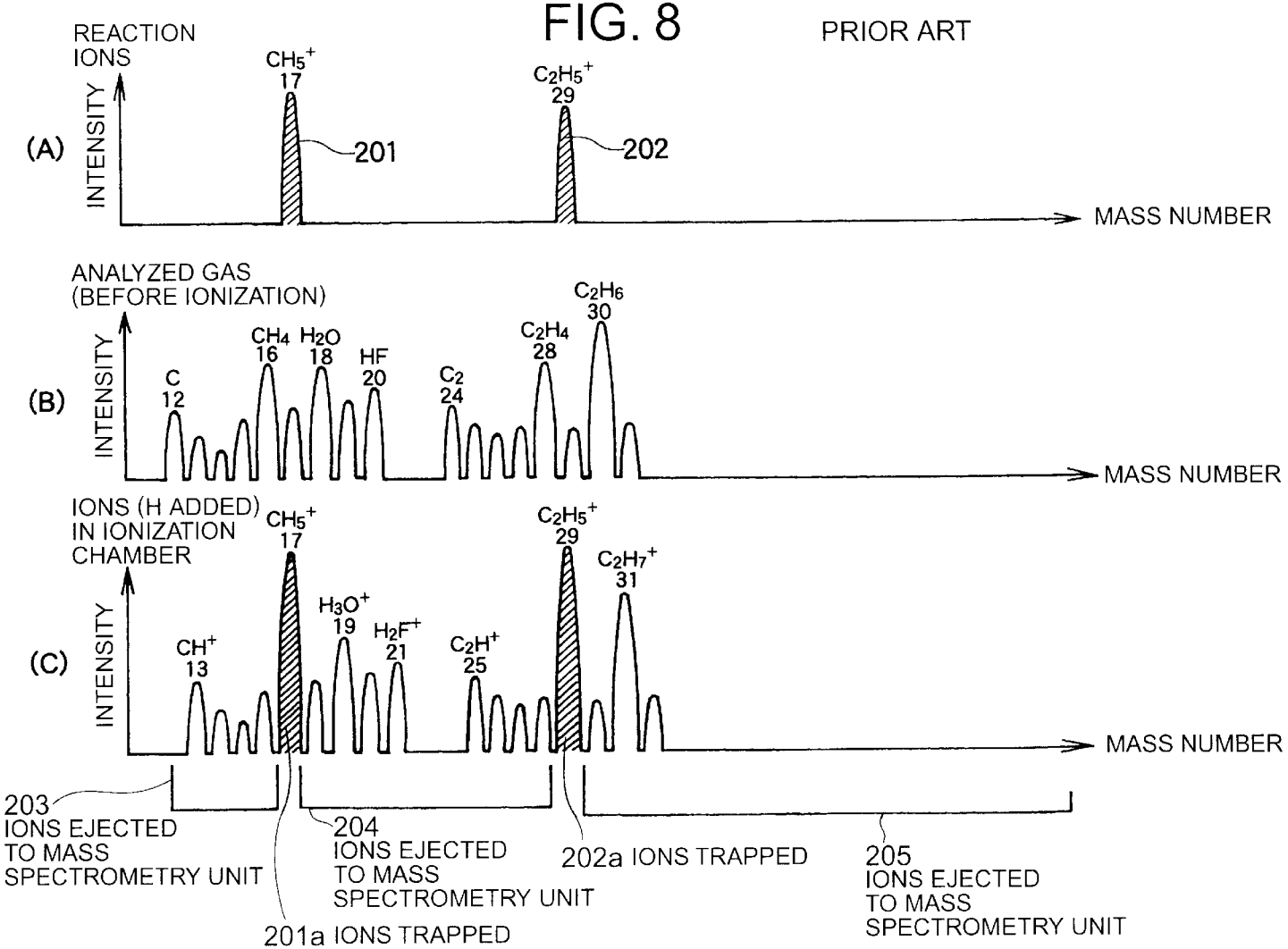
FIG. 8 PRIOR ART
FIG. 8 provides graphs of another example of the state of distribution of the mass number at the time of ionization by an ionization apparatus based on chemical ionization.

Note that in FIG. 8, 31 is a Q-pole, while 32 is a resistor attached to the Q-pole 31. Resistors 32 are wound around each Q-pole 31 in five locations. Each resistor 32 is supplied with an alternating current voltage from the alternating current power source 33 through a capacitor 34 and further is supplied with a direct current voltage by the direct current power source 35. The left end of the Q-pole 31 in the figure is grounded. Based on these supplied voltages, a potential characteristic 36 is formed as illustrated from the ion emitter 15 to the right end of the Q-pole 31. In this potential characteristic 36, the center region is the low voltage portion 36*a*. Since the potential characteristic 36 is produced in the region of the Q-pole 31, the metal ions emitted from the ion emitter 15 pass through the region of the inlet fringing 37 at the end surface, then the metal ions are trapped by the path as shown by 38. If an ion trap type structure which can trap metal ions and eject ions desired to be analyzed to the mass spectrometry unit, it is also possible to use for example a TOF type, sector type, ICR type, etc. in addition to a Q-pole type.

Still further, in the above explanation, the position where the ion emitter is placed is outside the ion trap type structure along its axis. The end gap electrodes are formed with holes for passage of the metal ions, but the invention is not necessarily limited to this. For example, it is also possible to form a hole in the ring-shaped electrode and place the ion emitter near its outside. Further, when there is a large difference in mass between the ions desired to be trapped and the ions to be ejected to the mass spectrometry unit, it is also possible to arrange it inside the ion trap type structure. In this case, it is possible to effectively utilize the metal ions emitted from the ion emitter for ionization of the sample gas.

The present invention can be configured in any way by combining the features of the embodiments explained above. Further, in the above explanation of the embodiments, the configuration of the apparatus according to the present inventions shown in the drawings was shown schematically to an extent enabling understanding of the invention. The limitations on the substances and figures shown are however only illustrations. Therefore, the present invention is not limited to the above embodiments and of course may be applied in various manners within a scope not outside the technical concept described in the claims.

The present disclosure relates to subject matter contained in Japanese Patent Application No. 2000-342346, filed on Nov. 9, 2000, the disclosure of which is expressly incorporated herein by reference in its entirety.

What is claimed is:

1. An ionization apparatus for mass spectrometry using an ion trap structural unit as an ion source in which metal ions are attached to a sample gas to make ions capable of being measured in a mass spectrometry unit, provided with an ion emitter for emitting metal ions inside or outside said ion source and attaching said metal ions to ingredients of a sample gas to ionize the sample gas, changing a separation parameter to separate ions relating to a target substance for analysis and said metal ions, trapping and accumulating said metal ions inside said ion source, and ejecting said ions relating to the target substance to the mass spectrometry unit.

2. An ionization apparatus for mass spectrometry as set forth in claim 1, wherein said ion trap type structural unit is comprised of a ring-shaped electrode and two end gap electrodes.

3. An ionization apparatus for mass spectrometry as set forth in claim 2, wherein said ring-shaped electrode has a cylindrical shape and the two end gap electrodes have disk shapes.

4. An ionization apparatus for mass spectrometry as set forth in claim 3, wherein an insulator is provided between said ring-shaped electrode and each of two end gap electrodes;

said sample gas is directly introduced inside said ion source;

said ion emitter is provided outside said ion source; and an ionization chamber in which said ion source is placed is evacuated so that a pressure outside said ion source becomes lower than a pressure inside it.

5. An ionization method for mass spectrometry using an ion trap structural unit as an ion source in which metal ions are attached to a sample gas to make ions capable of being measured in a mass spectrometry unit, comprising:

generating metal ions;

attaching said metal ions to ingredients of a sample gas to ionize the sample gas;

changing a separation parameter to separate ions relating to a target substance for analysis and said metal ions;

trapping and accumulating said metal ions inside said ion source; and ejecting said ions relating to a target substance to a mass spectrometry unit.

6. An ionization apparatus for mass spectrometry using an ion trap structural unit as an ion source in which metal ions are attached to a sample gas to make ions capable of being measured in a mass spectrometry unit, comprising:

an ion emitter for emitting metal ions inside or outside said ion source so that said metal ions are attached to ingredients of a sample gas to ionize the sample gas;

an ion trap structural unit for changing a separation parameter to separate ions relating to a target substance for analysis from the metal ions and for trapping and accumulating the metal ions; and a mass spectrometry unit, wherein said ions relating to the target substance are ejected to the mass spectrometry unit.

7. An ionization apparatus for mass spectrometry as set forth in claim 6, wherein said ion trap type structural unit is comprised of a ring-shaped electrode and two end gap electrodes.

8. An ionization apparatus for mass spectrometry as set forth in claim 7, wherein said ion trap type structural unit is comprised of a ring-shaped electrode and two end gap electrodes.

9. An ionization apparatus for mass spectrometry as set forth in claim 8, wherein said ring-shaped electrode has a cylindrical shape and the two end gap electrodes have disk shapes.

* * * * *